US007874427B2

(12) United States Patent
Hardy

(10) Patent No.: US 7,874,427 B2
(45) **Date of Patent: *Jan. 25, 2011**

(54) LINEAR FLUORESCENT LAMP END CAP LOCKING SYSTEM

(75) Inventor: Gregory J. Hardy, North Andover, MA (US)

(73) Assignee: OSRAM Sylvania Inc., Danvers, MA (US)

( * ) Notice: Subject to any disclaimer, the term of this patent is extended or adjusted under 35 U.S.C. 154(b) by 218 days.

This patent is subject to a terminal disclaimer.

(21) Appl. No.: 11/656,195

(22) Filed: Jan. 22, 2007

(65) Prior Publication Data

US 2008/0110781 A1 May 15, 2008

Related U.S. Application Data

(60) Provisional application No. 60/859,150, filed on Nov. 15, 2006.

(51) Int. Cl.
*B65D 85/42* (2006.01)

(52) U.S. Cl. ..... 206/419; 206/593

(58) Field of Classification Search ..... 206/434, 206/418–422, 443, 591–594, 784; 229/87.02, 229/89, 120.08, 120.11–120.23
See application file for complete search history.

(56) References Cited

U.S. PATENT DOCUMENTS 1,985,075 A 12/1934 Bird
3,337,033 A * 8/1967 Cote ..... 206/418
3,973,675 A * 8/1976 Brand et al. ..... 206/418
4,231,510 A * 11/1980 Beard ..... 206/422
4,880,114 A * 11/1989 Korte ..... 206/418
4,921,099 A * 5/1990 Trauschke ..... 206/418

(Continued)

OTHER PUBLICATIONS

European Search report, 4 pages (Note, the US publication first listed in the report is in error. The correct number is 200040099556 A1), Mar. 3, 2008.

(Continued)

*Primary Examiner*—Jacob Y Choi
*Assistant Examiner*—Jimmy T Vu
(74) *Attorney, Agent, or Firm*—William H. McNeill

(57) ABSTRACT

A locking system for two linear fluorescent lamps comprises an endcap (10) formed to receive two linear fluorescent lamps (12, 14) (FIG. 3). The endcap (10) has two chambers (16, 18) formed by the outside surfaces of endcap (10) and a central partition (19). Each of the chambers has a forward portion (20) and a rearward portion (22). The endcap (10) has a width W equal to the diameter of the fluorescent lamps, a length L equal to twice the diameter of the fluorescent lamps and a depth, for example, 4 to 6 inches, that is substantially less than the length of the lamps, which can be one to eight feet long. A stop (24) is formed in each of the chambers at the forward portion (20) to retain the lamps within the endcap. Each of the stops (24), in the form of a reverse corner, extends inwardly toward the center of the endcap and has a first leg (26) with a first dimension equal to the width W and a second leg (28) with a second dimension that is greater than one half of said width W but less than the width W. The first leg (26) is provided with a score line (72) that divides the first leg into two segments.

2 Claims, 3 Drawing Sheets

U.S. PATENT DOCUMENTS

| | | | | |
|---|---|---|---|---|
| 4,997,087 | A | 3/1991 | Lorenz | |
| 5,730,289 | A * | 3/1998 | Cappels | 206/434 |
| 6,877,606 | B2 * | 4/2005 | Hardy | 206/419 |
| 7,353,945 | B2 * | 4/2008 | Roderwieser | 206/418 |
| 2004/0099556 | A1 | 5/2004 | Hardy | |

OTHER PUBLICATIONS

Notice from European Patent Office indicating allowance of claims, 4 pages, Aug. 6, 2010.

* cited by examiner

LINEAR FLUORESCENT LAMP END CAP LOCKING SYSTEM

CROSS-REFERENCE TO RELATED APPLICATION

This application claims priority from Provisional Patent Application No. 60/859,150, filed Nov. 15, 2006.

TECHNICAL FIELD

This invention relates to linear fluorescent lamps and more particularly to packaging for such lamps. Still more particularly it relates to packaging ideally suited for automatic assembly.

BACKGROUND ART

Previous techniques for packaging small quantities of fluorescent lamps (for example, two lamps or four lamps) employed endcaps formed from folding carton material or paper or cardboard with inwardly extending dimples in an F-shape to extend across the ends of the lamps and a shrink-wrap to complete the package.

While workable, these endcaps were difficult to manufacture and difficult to automate. Additionally, the shrink-wrap was difficult to apply and added to the cost of lamps.

An improved endcap solved many of these problems and is shown in U.S. Pat. No. 6,877,606 by the inventor of the instant endcap and assigned to the assignee of this invention. However, while this endcap proved to be easily foldable by hand, problems arose in achieving consistency of construction when the endcap was subjected to automated bending and folding.

DISCLOSURE OF INVENTION

It is, therefore, an object of the invention to obviate the disadvantages of the prior art.

It is another object of the invention to enhance fluorescent lamp packaging.

Yet another object of the invention is the provision of endcaps that are consistently and correctly formed by automated equipment.

These objects are accomplished, in one aspect of the invention, by a locking system for two linear fluorescent lamps that comprises an endcap formed to receive two linear fluorescent lamps. The endcap has two chambers each with a forward portion and a rearward portion, has a height equal to the diameter of the fluorescent lamps, a width equal to twice the diameter of the fluorescent lamps and a length that is substantially less than the length of the lamps. A stop is formed in each of the chambers at the forward portion and each of the stops extends inwardly toward the center of the endcap and has a first leg with a first dimension equal to the height and a second leg with a second dimension that is greater than one half of the height. The first leg is provided with a score line that divides the first leg into two segments.

Breaking up the first leg into two segments allows automatic assembly by permitting the first leg to more easily and consistently assume its desired orientation.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
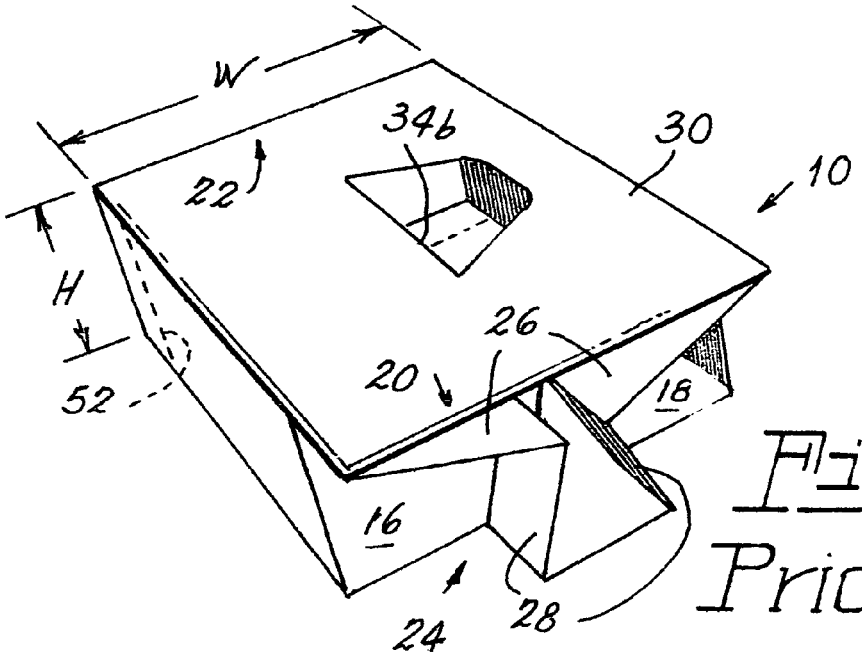
Fig. 1 Prior Art
FIG. 1 is a perspective view of a prior art endcap.
Figure 2:
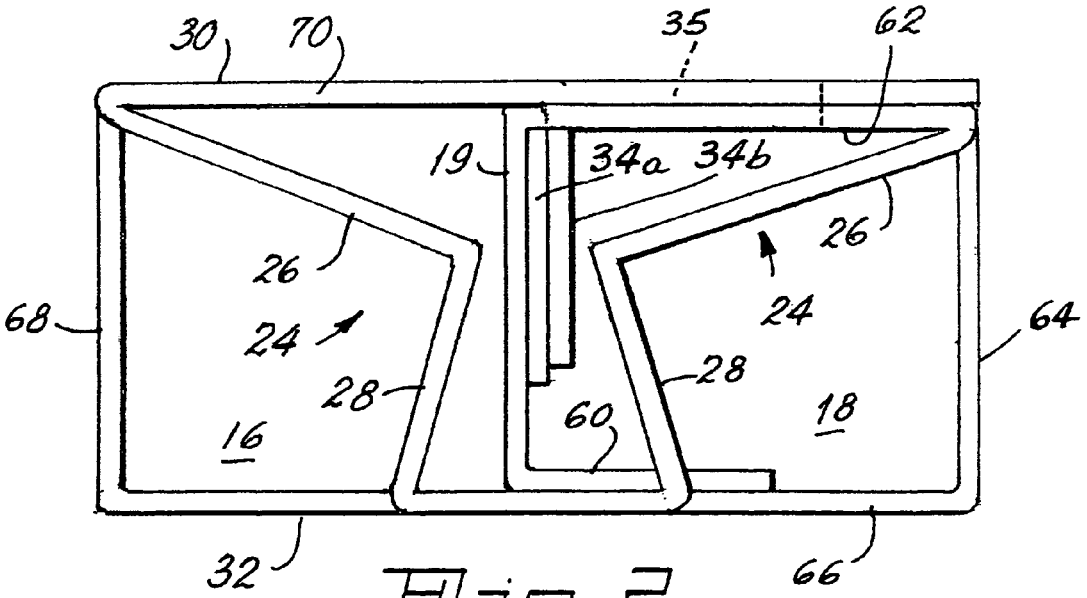
Fig. 2 Prior Art
FIG. 2 is an end elevational view of the prior art endcap of FIG. 1.
Figure 3:
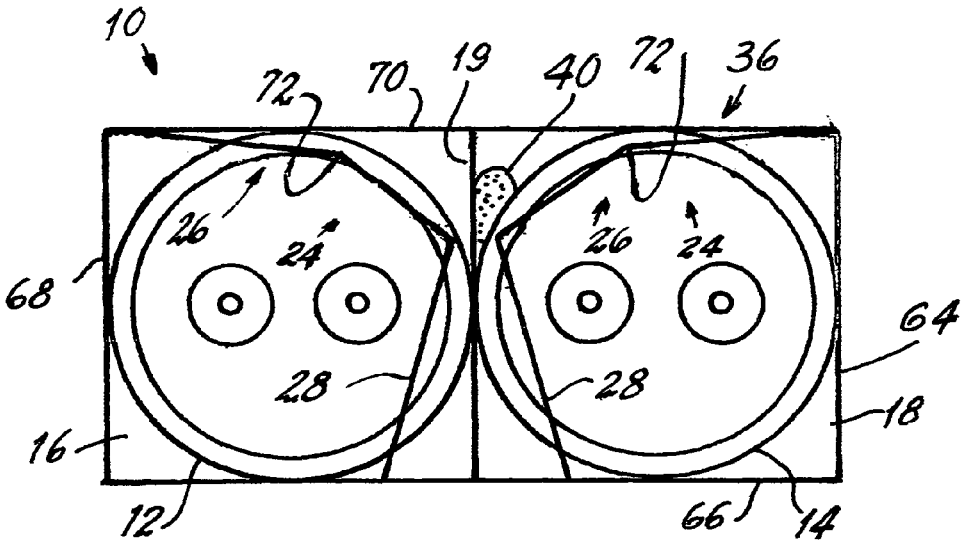
FIG. 3 is an end elevational view of an embodiment of the endcap of the invention.

Referring now to the invention with greater particularity, there is shown in FIG. 1 a prior art locking system for two linear fluorescent lamps, comprising an endcap 10 formed to receive two linear fluorescent lamps 12, 14 (FIG. 3). The endcap 10 has two chambers 16, 18 formed by the outside surfaces of endcap 10 and a central partition 19. Each of the chambers has a forward portion 20 and a rearward portion 22. The endcap 10 has a height H equal to the diameter of the fluorescent lamps, a width W equal to twice the diameter of the fluorescent lamps, a center divider 19, and a length, for example, 4 to 6 inches, that is substantially less than the length of the lamps, which can be from one to eight feet long or greater. A stop 24 is formed in each of the chambers at the forward portion 20 to retain the lamps within the endcap. Each of the stops 24, in the form of a reverse corner, extends inwardly toward the center of the endcap and has a first leg 26 with a first dimension equal to the height H and a second leg 28 with a second dimension that is greater than one half of said height H but less than the height H. When the legs are reverse-folded they must extend beyond the lamp base pins, insuring that the panels cannot collapse to original position 50 (shown in FIG. 4)

The stops 24 are formed by cutting the sides 50 of the endcap from top to bottom to form a slit 52 and by cutting the lower surface 32 to form a slit 54, thus allowing the corner to be pushed inwardly toward the center of endcap 10 and forming the stop 24. The appropriate slits are shown by dashed lines in FIG. 4.

The prior art endcaps 10 have an upper surface 30 and a lower surface 62 that have tabs 34*a* and 34*b* formed therein that extend inwardly and rest against center divider 19.

The endcap preferably is made from a single sheet of material that is scored to allow folding of the material into the endcap unit. Thus, the endcap structure comprises an extension 60, the center partition 19, a top 62 for chamber 18, a descending wall 64, a bottom 66, an ascending wall 68 for chamber 16 and an overlying cover 70, which is a part of top 30. Glue is applied between extension 60 and bottom 66 and overlying cover 70 and upper surface 30.

Figure 4:
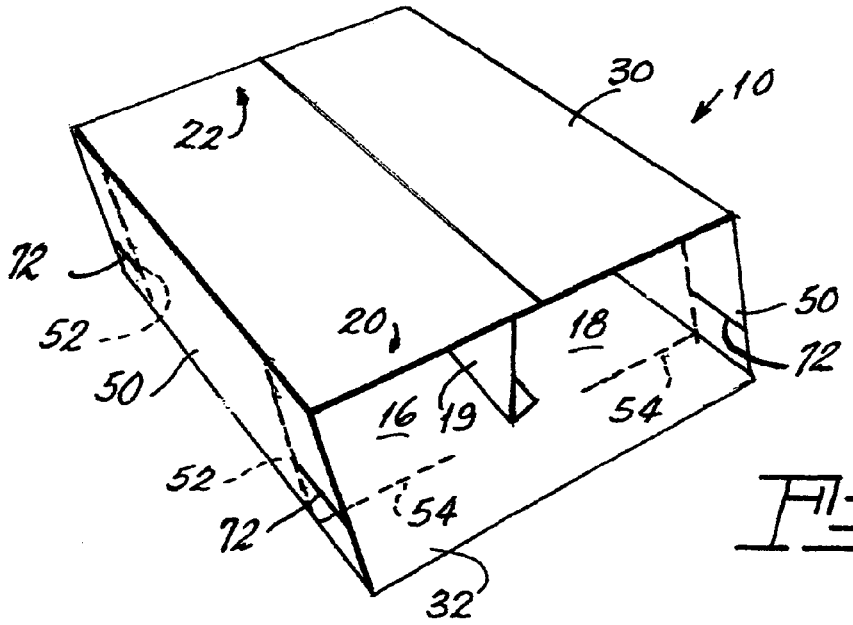
FIG. 4 is a perspective view of the endcap of FIG. 3 before bending of the legs.

As can be seen from FIGS. 1 and 4, the slits 52 and 54 can be formed on both ends of the endcap, although only one set will be employed to form the stops 24.

The endcaps when assembled are used to form a fluorescent lamp package 36 that comprises two linear fluorescent lamps 12, 14 arranged side-by-side with an endcap 10 at either end (see FIG. 3). The endcaps are slid upon the lamps until contact is made with the stops 24.

In the prior endcap art a quantity of adhesive 40 about the size of a U.S. quarter (i.e., about one inch or 2.54 cm in diameter or less) is dispensed through an opening 35 provided by tabs 34*a* and 34*b* and adheres to the exposed lamp and tab

34*b* on both endcaps. The adhesive should not be exposed to the outer surface 70 of the endcap. Note: the second lamp is locked in place by the two endcaps adhering to the same lamp. The left and right endcaps must have the same opening orientation to ensure that the same lamp is adhered to both endcaps.

It is preferable that the adhesive 40 will release from the glass lamp cleanly when the endcaps are removed by the ultimate user of the lamps; also the adhesive must have a bond sheer strength that can withstand user handling and remain in place until the user desires to use the lamps. In a preferred embodiment of the invention, this adhesive is preferably one designated HM2703 and available from the H. B. Fuller Company, or one designated H5077 and available from Bostik Findley.

A preferred material for the endcaps is folding carton stock with calipers ranging from 0.018 up to 0.024. There is a vast array of useable materials, ranging from folding carton, single face corrugated, and plastic that also could be used to produce endcaps.

As previously noted, the endcap design described above works well when formation of the stops 24 occurs by hand; however, the "two-leg" design lacked consistent alignment when folded on automatic machinery.

Figure 5:
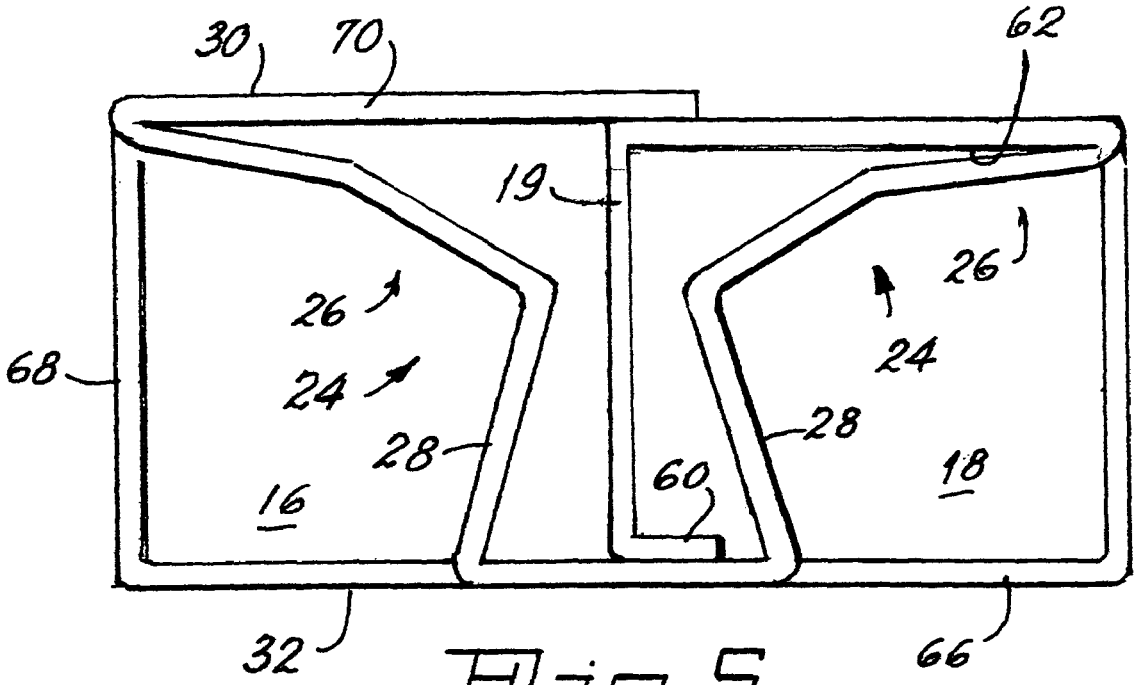
FIG. 5 is an elevational view of an endcap after the legs have been bent to form the stops but with the lamps omitted for clarity.

The improved version of the endcaps is shown in FIGS. 3-5 and comprises a "three-leg" design that folds much more consistently. That is, the first leg 26 is provided with a score line 72 that divides the first leg 26 into two segments, 72*a* and 72*b* (seen most clearly in FIG. 5). The addition of the score line 72 allows for more consistent control of the fold when mechanically forming the ends automatically and insures that the lamp pins don't come into contact with the carton. The added strength provided also allowed for the elimination of the center wipe-in panels 34*a* and 34*b*, thus reducing the overall blank size and, concomitantly, material requirements.

Thus there is provided a consistent locking panel position to insure lamp pin clearance, and increased locking panel strength insuring lamp containment. Further, the new panel improves machine efficiency by minimizing machine jams.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A locking system for two linear fluorescent lamps comprising an endcap formed to receive two linear fluorescent lamps, said endcap having two chambers each with a forward portion and a rearward portion, said endcap having a height equal to the diameter of said fluorescent lamps, a width equal to twice the diameter of said fluorescent lamps and a length that is substantially less than the length of said lamps; and a stop formed in each of said chambers at said forward portion, each of said stops extending inwardly toward the center of said endcap and having a first leg with a first dimension equal to said height and a second leg with a second dimension that is greater than one half of said height, wherein the improvement comprises said first leg being provided with a score line that divides said first leg into two segments.

2. The locking system of claim 1 wherein said two segments are of unequal length.

* * * * *